US006386939B1

(12) United States Patent
Wu et al.

(10) Patent No.: US 6,386,939 B1
(45) Date of Patent: May 14, 2002

(54) PINWHEEL DEVICE

(76) Inventors: Pao-Chang Wu, 3F, 22, Lane 40, Second Pao An St., Su Lin Town, Taipei Shien (TW); Ping-Chao Lin, 9811 Talleyan Dr., Austin, TX (US) 78750

( * ) Notice: Subject to any disclaimer, the term of this patent is extended or adjusted under 35 U.S.C. 154(b) by 0 days.

(21) Appl. No.: 09/828,393

(22) Filed: Apr. 6, 2001

(51) Int. Cl.[7] ..... A63H 33/40
(52) U.S. Cl. ..... 446/218; 446/217; 40/440
(58) Field of Search ..... 446/218, 217; 40/440

(56) References Cited

U.S. PATENT DOCUMENTS 903,879 A * 11/1908 Nusly, Jr. ..... 446/218
1,580,601 A * 4/1926 Hugill ..... 446/218
1,583,881 A * 5/1926 Heberling ..... 446/218
1,685,134 A * 9/1928 Luipersbek ..... 446/218
1,910,923 A * 5/1933 Kerr ..... 446/218
2,108,002 A * 2/1938 Smith et al. ..... 446/218
2,452,865 A * 1/1948 Nietsche ..... 446/218
2,646,644 A * 7/1953 Richmond ..... 446/218
3,675,364 A * 7/1972 Halpern ..... 446/218
3,837,112 A * 9/1974 Peterson ..... 446/218
D336,513 S * 6/1993 Junkin et al. ..... D23/413
5,659,988 A * 8/1997 Kim et al. ..... 446/218
6,247,897 B1 * 6/2001 Patel ..... 416/197 R

* cited by examiner

*Primary Examiner*—Jacob K. Ackun, Jr.
*Assistant Examiner*—Urszula M. Cegielnik
(74) *Attorney, Agent, or Firm*—Alan Kamrath; Rider, Bennett, Egan & Arundel, LLP

(57) ABSTRACT

A pinwheel device has a main shaft, a rotating wheel connected to the main shaft, and a first support rod, a second support rod, and a third support rod connected to the rotating wheel. A first decoration wheel is disposed on the rotating wheel. A second decoration wheel is disposed on the first support rod. A third decoration wheel is disposed on the second support rod.

2 Claims, 5 Drawing Sheets

PINWHEEL DEVICE

BACKGROUND OF THE INVENTION

The present invention relates to a pinwheel device. More particularly, the present invention relates to a pinwheel device which has a plurality of decoration wheels.

A conventional pinwheel device has a single decoration wheel. The decoration wheel has a plurality of paper vanes.

SUMMARY OF THE INVENTION

An object of the present invention is to provide a pinwheel device which has a plurality of decoration wheels to rotate at the same time.

Another object of the present invention is to provide a pinwheel device which can be used as a kite.

Accordingly, a pinwheel device comprises a main shaft, a rotating wheel connected to the main shaft, and a first support rod, a second support rod, and a third support rod connected to the rotating wheel. A first decoration wheel is disposed on the rotating wheel. The first decoration wheel has a plurality of first vanes. A second decoration wheel is disposed on the first support rod. The second decoration wheel has a plurality of second vanes. A third decoration wheel is disposed on the second support rod. The third decoration wheel has a plurality of third vanes.

DETAILED DESCRIPTION OF THE INVENTION

Figure 1:
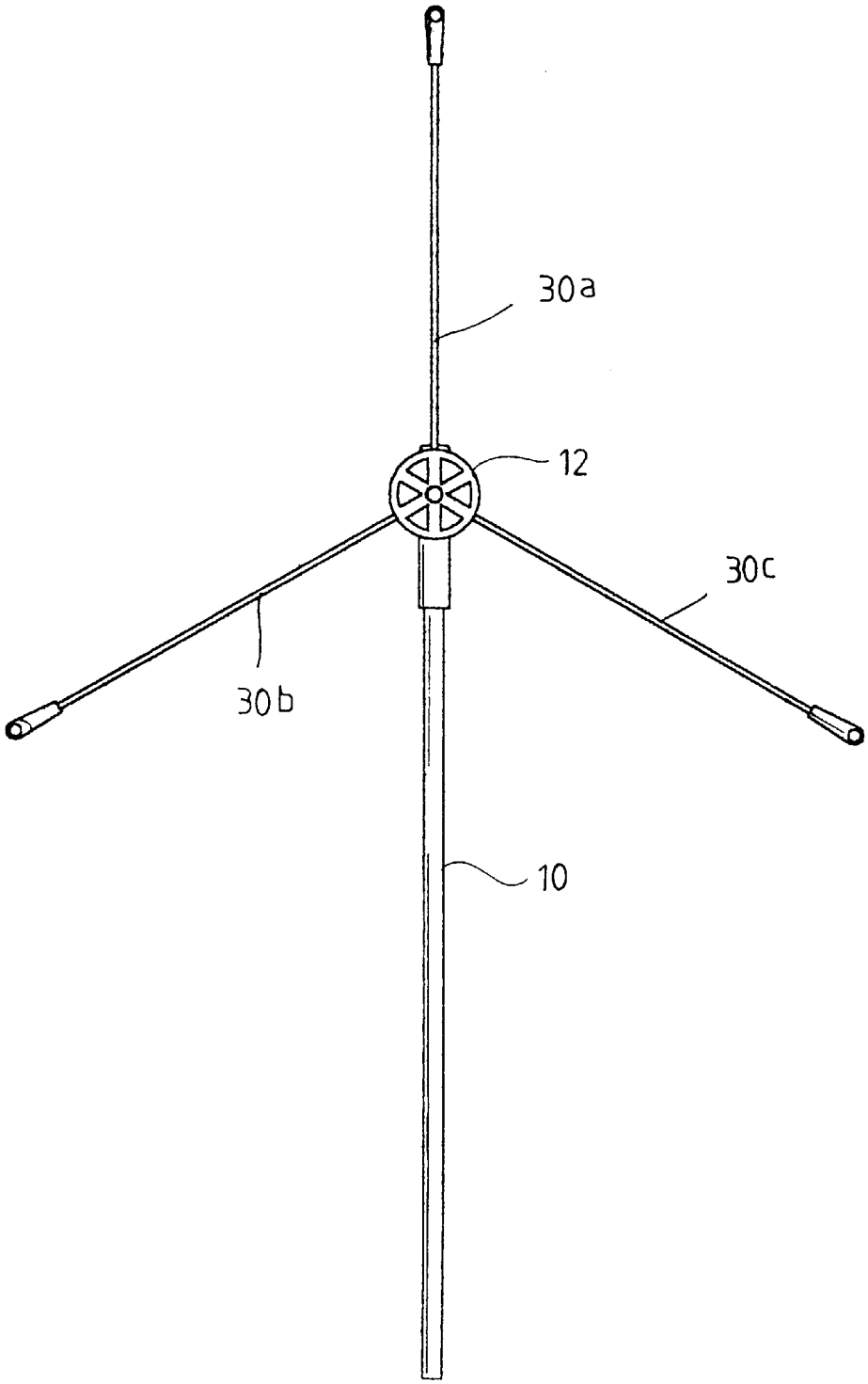
FIG. 1 is a perspective view of a pinwheel device of a first preferred embodiment without decoration wheels.
Figure 2:
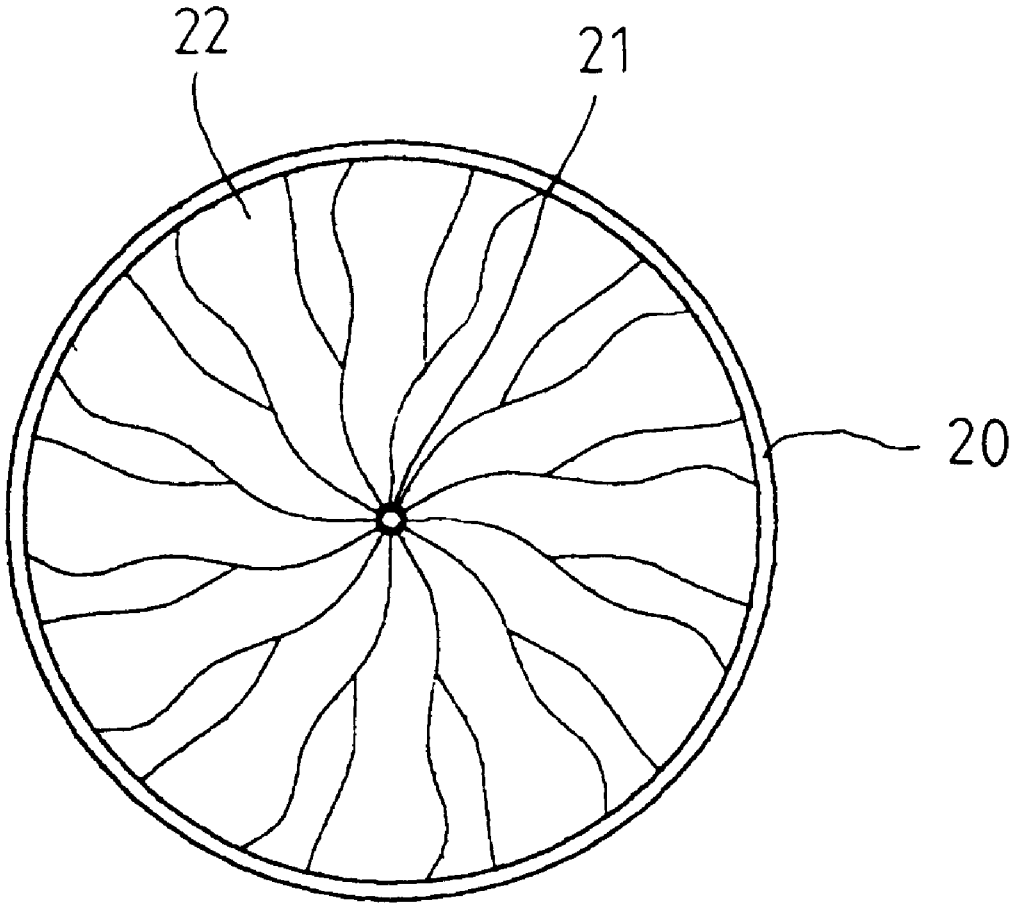
FIG. 2 is an elevational view of a decoration wheel of a first preferred embodiment in accordance with the present invention.
Figure 3:
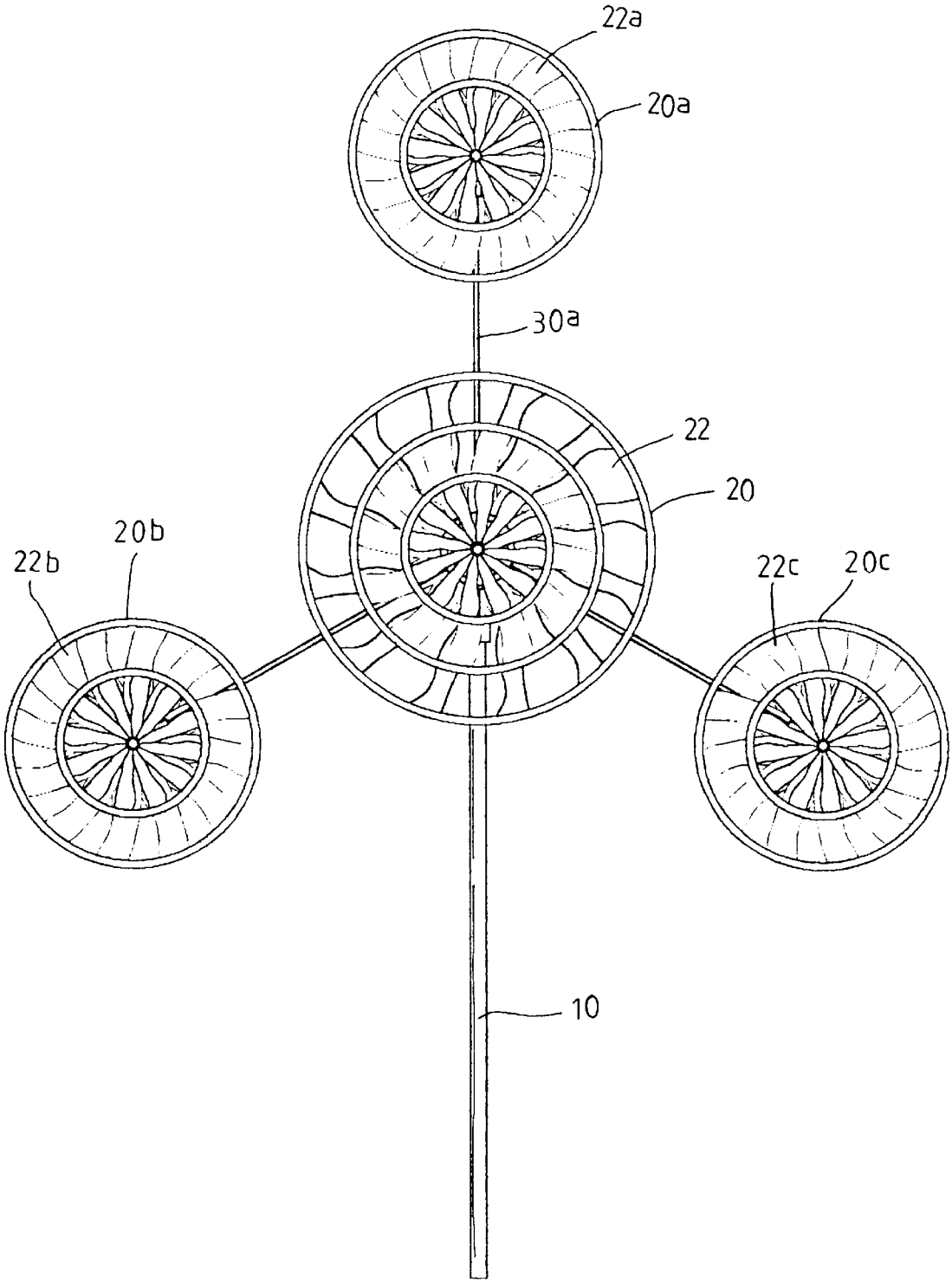
FIG. 3 is an elevational view of a pinwheel device of a first preferred embodiment in accordance with the present invention.

Referring to FIGS. 1 to 3, a first pinwheel device comprises a main shaft 10, a rotating wheel 12 connected to the main shaft 10, and a first support rod 30*a*, a second support rod 30*b*, and a third support rod 30*c* connected to the rotating wheel 12.

A first decoration wheel 20 is disposed on the rotating wheel 12. The first decoration wheel 20 has a plurality of first fabric vanes 22 and a center hole 21.

A second decoration wheel 20*a* is disposed on the first support rod 30*a*. The second decoration wheel 20*a* has a plurality of second fabric vanes 22*a*.

A third decoration wheel 20*b* is disposed on the second support rod 30*b*. The third decoration wheel 20*b* has a plurality of third fabric vanes 22*b*.

Figure 4:
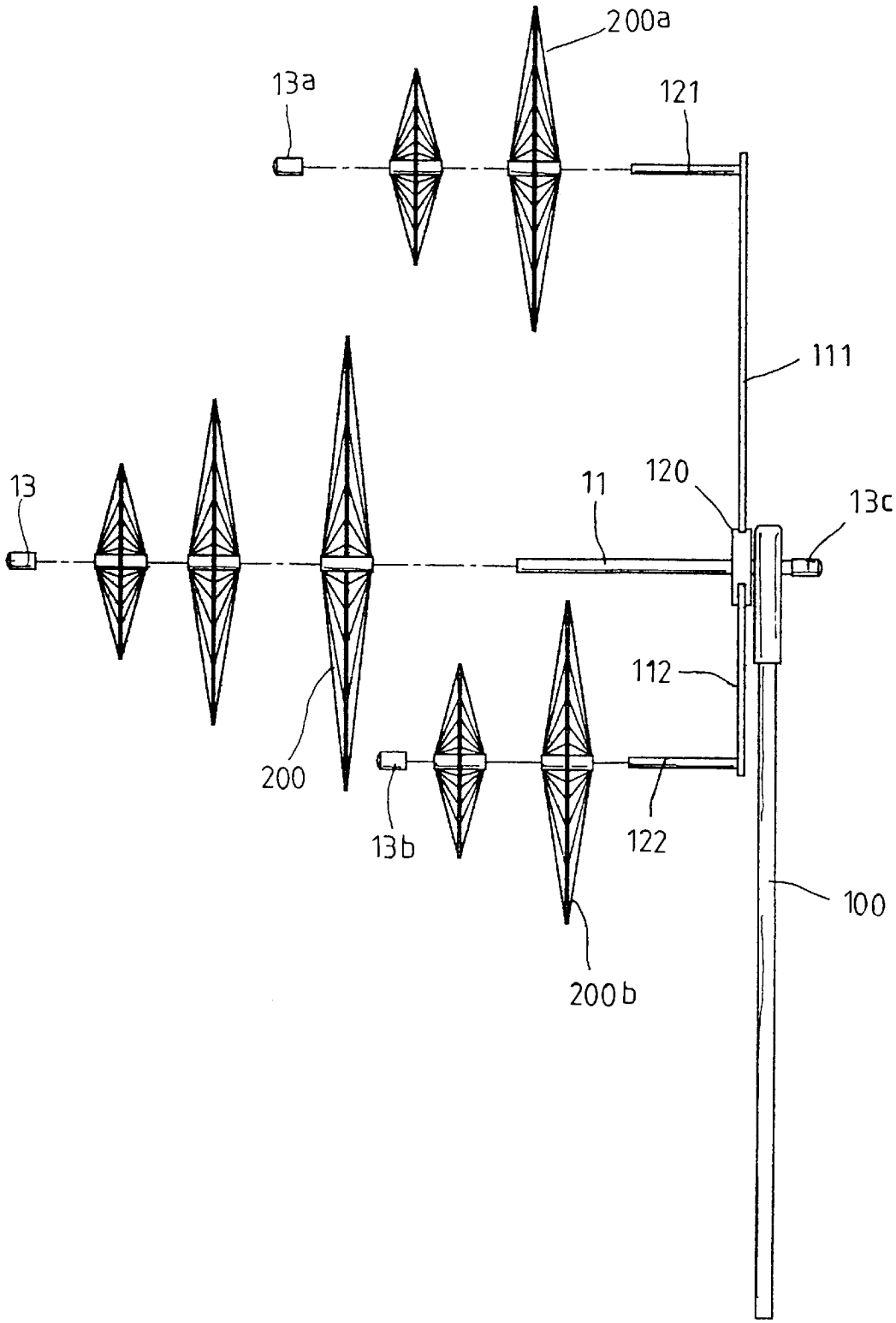
FIG. 4 is an elevational exploded view of a pinwheel device of a second preferred embodiment in accordance with the present invention.
Figure 5:
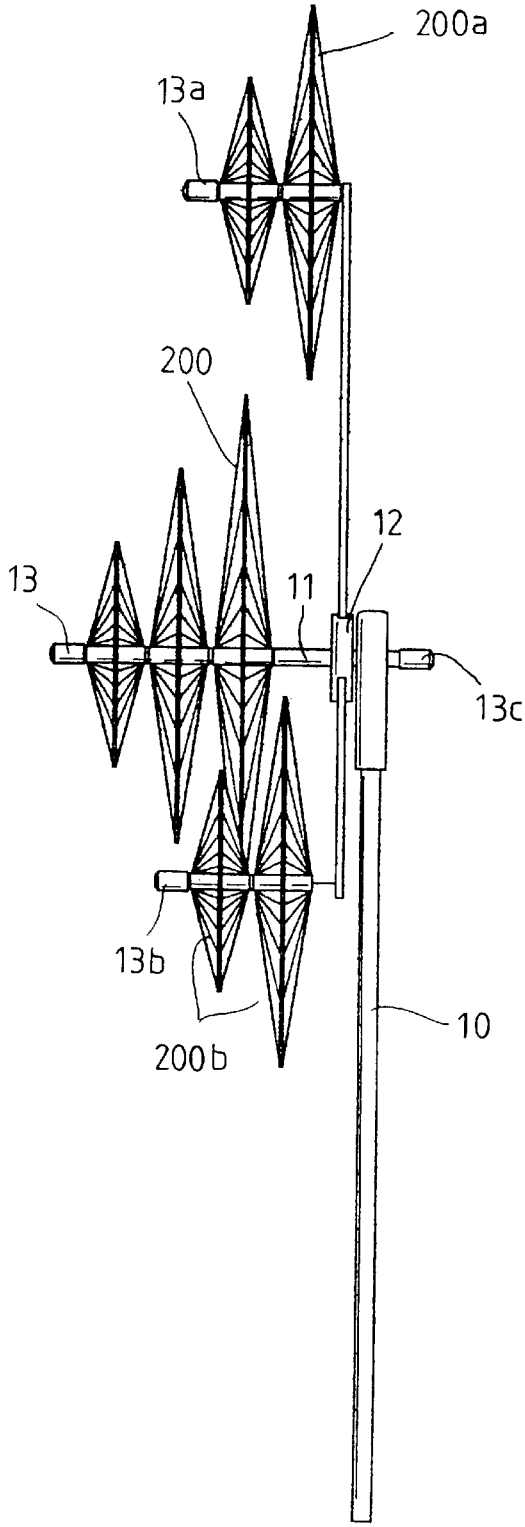
FIG. 5 is an elevational assembly view of a pinwheel device of a second preferred embodiment in accordance with the present invention.

Referring to FIGS. 4 and 5, a second pinwheel device comprises a main shaft 10, a rotating wheel 120, a first support rod 11 passing through the main shaft 10 and the rotating wheel 120, and a second support rod 111 and a third support rod 112 connected to the rotating wheel 120.

A first auxiliary shaft 121 is disposed on the second support rod 111.

A second auxiliary shaft 122 is disposed on the third support rod 112.

A plurality of first decoration wheels 200 are disposed on the first support rod 11.

A plurality of second decoration wheels 200*a* are disposed on the first auxiliary shaft 121.

A plurality of third decoration wheels 200*a* are disposed on the second auxiliary shaft 122.

A first sleeve 13 engages with an end of the first support rod 11.

A second sleeve 13*a* engages with an end of the first auxiliary shaft 121.

A third sleeve 13*b* engages with an end of the second auxiliary shaft 122.

A fourth sleeve 13*c* engages with another end of the first support rod 11.

The present invention is not limited to the above embodiments but various modification thereof may be made. Furthermore, various changes in form and detail may be made without departing from the scope of the present invention.

We claim:

1. A pinwheel device comprises:

a main shaft, a rotating wheel, a first support rod passing through the main shaft and the rotating wheel, and a second support rod and a third support rod connected to the rotating wheel, a first auxiliary shaft disposed on the second support rod, a second auxiliary shaft disposed on the third support rod, a plurality of first decoration wheels disposed on the first support rod, a plurality of second decoration wheels disposed on the first auxiliary shaft, and a plurality of third decoration wheels disposed on the second auxiliary shaft.

2. The pinwheel device as claimed in claim 1, wherein a first sleeve engages with an end of the first support rod, a second sleeve engages with an end of the first auxiliary shaft, a third sleeve engages with an end of the second auxiliary shaft, and a fourth sleeve engages with another end of the first support rod.

* * * * *